US007320309B2

(12) United States Patent
Michalske et al.

(10) Patent No.: US 7,320,309 B2
(45) Date of Patent: Jan. 22, 2008

(54) METHOD AND DEVICE FOR CONTROLLING AN INTERNAL COMBUSTION ENGINE

(75) Inventors: Andreas Michalske, Leonberg (DE); Thomas Zein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/563,267

(22) PCT Filed: Jun. 12, 2004

(86) PCT No.: PCT/DE2004/001221

§ 371 (c)(1),
(2), (4) Date: Jun. 16, 2006

(87) PCT Pub. No.: WO2005/008048

PCT Pub. Date: Jan. 27, 2005

(65) Prior Publication Data

US 2007/0062504 A1 Mar. 22, 2007

(30) Foreign Application Priority Data

Jul. 10, 2003 (DE) ..... 103 31 159

(51) Int. Cl.
*F02D 41/14* (2006.01)

(52) U.S. Cl. ..... 123/443; 123/672; 701/103; 701/104; 701/109

(58) Field of Classification Search ..... 123/443, 123/672; 701/103, 104, 109
See application file for complete search history.

(56) References Cited

U.S. PATENT DOCUMENTS

| | | | | |
|---|---|---|---|---|
| 4,725,954 | A * | 2/1988 | Takao et al. | 701/110 |
| 5,755,212 | A | 5/1998 | Ajima | |
| 5,931,138 | A | 8/1999 | Uchida | |
| 6,234,156 | B1 * | 5/2001 | Muto | 123/698 |
| 6,397,830 | B1 * | 6/2002 | Dohta | 123/684 |
| 6,431,160 | B1 * | 8/2002 | Sugiyama et al. | 123/674 |
| 7,044,118 | B2 * | 5/2006 | Tonetti et al. | 123/674 |
| 2003/0005916 | A1 | 1/2003 | Osanai | |

FOREIGN PATENT DOCUMENTS

| | | |
|---|---|---|
| DE | 102 21 376 | 11/2003 |
| JP | 2000045852 | 2/2000 |

* cited by examiner

*Primary Examiner*—Erick Solis
(74) *Attorney, Agent, or Firm*—Kenyon & Kenyon LLP

(57) ABSTRACT

A method and device for controlling an internal combustion engine are provided. A first quantity characterizing the actually injected fuel amount and a second quantity characterizing the desired amount of fuel to be injected are determined on the basis of performance characteristics. The first quantity is compared to the second quantity. This comparison is used to define a first correction value for correcting a fuel amount and a second correction value for correcting an air amount. The first correction value is limited to a maximum value.

7 Claims, 3 Drawing Sheets

METHOD AND DEVICE FOR CONTROLLING AN INTERNAL COMBUSTION ENGINE

FIELD OF THE INVENTION

The present invention relates to a method for controlling an internal combustion engine.

BACKGROUND INFORMATION

Published German patent document DE 102 21 376 describes a method and a device for controlling an internal combustion engine. It describes a method and a device for controlling an internal combustion engine in which a lambda value of the exhaust gas is determined on the basis of performance characteristics. This value is compared to the actual lambda value, and this comparison is used to calculate a correction value for correcting a fuel amount signal or an air amount signal.

Essentially, a first quantity characterizing the actually injected fuel amount is determined from the sensor signal of a lambda sensor and an air mass sensor and compared to a second quantity characterizing the desired fuel amount to be injected. A first correction value for correcting a fuel amount and/or a second correction value for correcting an air amount is defined based on this comparison.

In an ideal, error-free system, the actually injected fuel amount must be equal to the desired fuel amount. Due to tolerances and/or aging effects, the desired fuel amount differs from the actually injected fuel amount. If the air amount metered to the engine is controlled and/or regulated as a function of the desired fuel amount to be injected, an erroneous air amount is set. Control as a function of the actually injected fuel amount is not able to be easily accomplished, because the actually injected fuel amount is difficult to determine. By measuring the lambda value of the exhaust gas and the air amount metered to the engine, the actually injected fuel amount may be computed and compared to the desired fuel amount to be injected. The difference between these two signals provides a correction value. This correction value may be used to influence the air system. This is accomplished, for example, by correcting the fuel amount value supplied to the air system using the appropriate correction value. Furthermore, the air amount may be directly corrected as appropriate. As an alternative to computing the fuel amount, the lambda signals or other quantities characterizing the fuel amount may also be used directly.

Alternatively, the fuel metering system may be influenced directly in such a way that a fuel amount quantity is corrected using the correction value until the fuel amounts to be injected and actually injected are the same. The problem with such a direct correction of the fuel amount is that such a correction may result in an increase in the amount of fuel. Therefore, for safety reasons, it is not desirable for direct intervention in the fuel amount to correct differences of any magnitude or for it to act in the entire range of engine operation.

These limitations do not apply in the case of indirect intervention, for example, via air control using exhaust gas recirculation. Because indirect intervention is at least equivalent or better in terms of emissions, indirect intervention in the air amount is preferred.

SUMMARY

Because errors in the injected amount may have a negative effect on driving performance, according to the present invention, the correction value affects the fuel amount and/or the air amount. The correction value affecting the fuel amount is limited to a maximum value in this context. Using this procedure, effects on both exhaust gas emissions and driving performance may be compensated for. In an example embodiment, the entire error is compensated by a direct intervention. If this is not possible, the remaining error is compensated by an indirect intervention. Direct intervention affects the fuel amount, while indirect intervention affects the air amount.

According to the present invention, the error in the fuel amount which corresponds to the difference between the actual and desired fuel amounts is partly compensated by a direct intervention in the metering and by adjustment of the air mass to the residual error in the fuel amount.

It is particularly advantageous if the type of intervention is selected as a function of the operating state of the engine. This is accomplished in particular by the fact that the limitation and thus the proportion of direct intervention is defined as a function of the operating states and is thus continuously adjusted. The rotational speed and/or a quantity characterizing the load on the engine may be used as performance characteristics.

The first and/or second correction value may be adapted. This means that in states in which the correction values may be determined, the correction values are saved in one or more characteristics maps as a function of the operating state of the engine, or quantities usable for computing the correction values by a mathematical method are determined and saved. In states in which the correction values may not be determined, the saved correction values or the saved quantities are used.

In an example embodiment, the cylinders of the engine are divided into at least two groups, and different second correction values are defined for the different groups. This means that the mean fuel amount error of both groups is corrected via a fuel amount intervention. The residual and/or individual errors of the individual groups are compensated via an indirect intervention.

Up to a certain error, correction may take place via a fuel amount intervention. For greater and/or asymmetric errors, an additional correction is performed via an air amount intervention.

DETAILED DESCRIPTION

The present invention is described below using the example of the amount of fuel to be injected. Instead of the fuel amount, quantities characterizing the fuel amount may also be used. Torque quantities, fuel volumes, and/or activation times of respective actuators may be used in particular.

Figure 1:
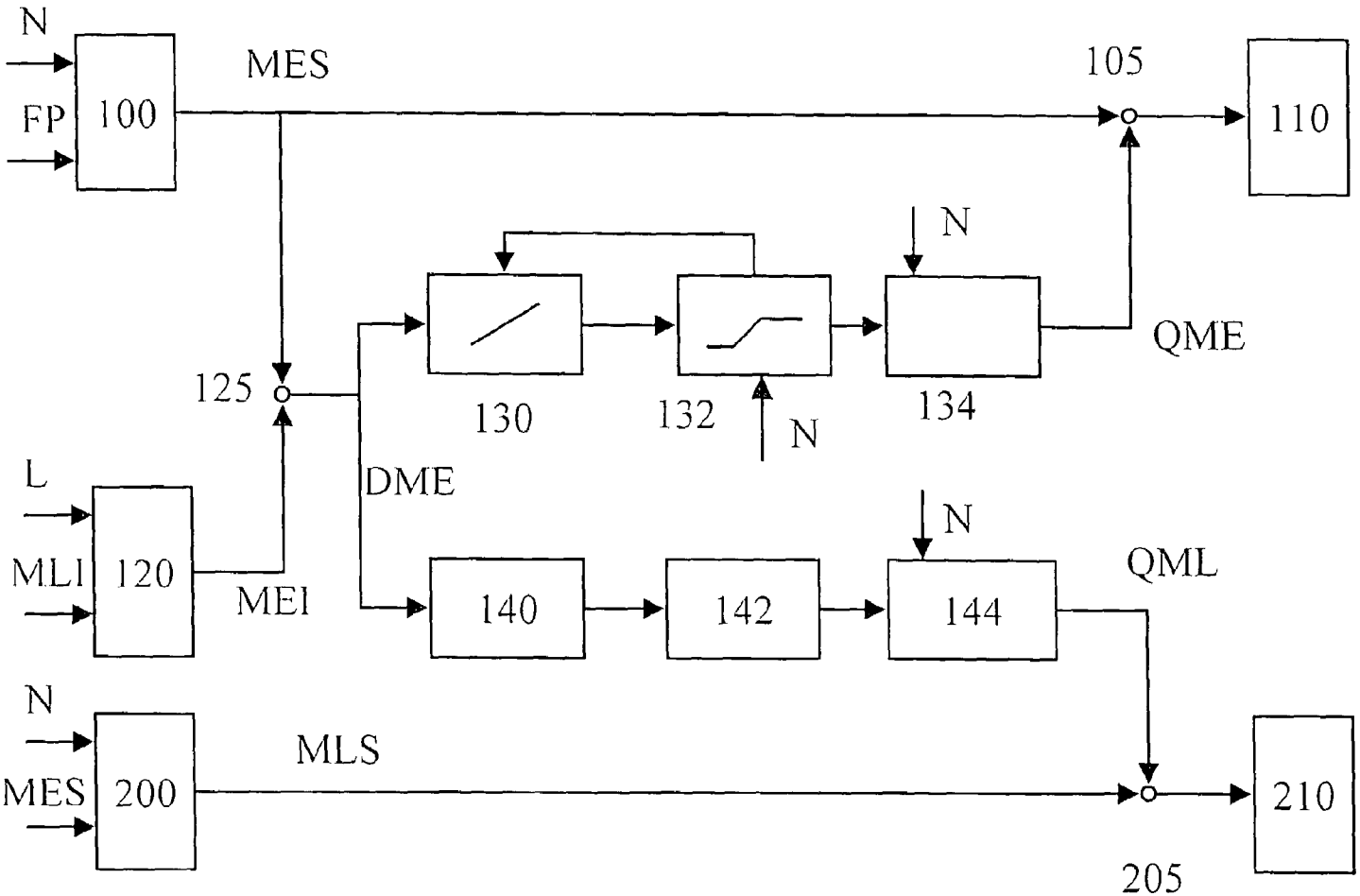
FIG. 1 shows a block diagram illustrating an example embodiment of the device according to the present invention.

In FIG. 1, a fuel amount controller 100 defines a desired fuel amount MES to be injected as a function of different input quantities, such as the rotational speed of the engine and a signal FP, which characterizes the driver's intent and is hereinafter also referred to as the second quantity. This signal related to the desired fuel amount to be injected is supplied to a fuel amount actuator 110 via a node 105. Fuel amount actuator 110 determines the point in time and the end, and thus the duration, of the fuel metering. It may be designed as a solenoid valve or as a piezoelectric actuator which is situated in an injector, an injection nozzle, or another actuator.

An air amount controller 200 delivers an air amount signal MLS on the basis of different input quantities, such as rotational speed N of the engine and a quantity MES characterizing the fuel amount to be injected. The output signal of fuel amount controller 100 is used as the input quantity for the fuel amount to be injected. An air amount actuator 210 receives output signal MLS of air amount controller 200 via a node 205. Air amount actuator 210 sets the corresponding air amount as a function of signal MLS for the desired fresh air amount. This is an actuator for influencing the recirculated exhaust gas amount in the form of an exhaust gas recirculation actuator, a throttle valve, which influences the air amount supplied to the engine, and/or a turbocharger.

A fuel amount calculator 120 uses different input quantities to determine a quantity MEI characterizing the actually injected fuel amount, which hereinafter is also referred to as the first quantity. The fuel amount calculator processes a signal L which characterizes the oxygen concentration in the exhaust gas and a signal MLI which characterizes the air amount supplied to the engine, as input quantities. The two signals are provided by sensors, in particular a lambda sensor, and an air mass meter. Alternatively, these signals may also be determined from other quantities.

In addition to the input quantities illustrated in FIG. 1, other input quantities may be taken into account by the fuel amount controller, the air amount controller and the fuel amount calculator.

First and second quantities MES and MEI are supplied to a node 125 with opposite signs. Output signal DME of the node provides the difference between the actually injected fuel amount and the desired fuel amount to be injected. This signal DME for the injected amount error is supplied to a first characteristics map 134 via an integrator 130 and a limiter 132. The second input of node 105 receives output signal QME of the first characteristics map. In turn, limiter 132 supplies a signal to integrator 130. Both limiter 132 and characteristics map 134 receive different performance characteristics, such as rotational speed N of the engine and other quantities.

Furthermore, signal DME for the injected amount error is supplied via a filter 140 and a sign inverter 142 to a second characteristics map 144, whose output signal QML is supplied to the second input of node 205. Second characteristics map 144 also receives different signals for different performance characteristics, such as rotational speed N.

Integrator 130 and limiter 132 act as integral controllers having output quantity limiting and anti-windup functions. This means that the injection amount error is integrated by integrator 130. On reaching the limiting value of limiter 132, the integrator is stopped; this is indicated by the connection between the limiter and integrator 130. As soon as the limiting value of limiter 132 is reached, the output signal of the limiter remains at the value that has been reached.

In one example embodiment of the present invention, the limiting value of limiter 132, to which the output signal of integrator 130 is limited, is definable as a function of the operating state of the engine. The limiting value may be defined as a function of speed N of the engine and/or other performance characteristics.

The output signal of limiter 132 is the fuel amount error which is to be compensated by a direct intervention in the fuel amount. It is adjusted in downstream first characteristics map 134. This means that when a certain operating point of the engine is reached, which may be defined by the engine speed and the load, the injection amount error is determined, integrated, and limited on the basis of the comparison between the first and second quantities. The value thus determined is then saved in characteristics map 134 as a function of the operating point.

According to an example embodiment of the present invention, the fuel amount is to be corrected only in certain operating ranges. This is ensured by setting the limiting value to zero in the other operating ranges in which no fuel correction is to be performed. Fuel metering and thus the driving performance are adapted at the other operating points. At the other operating points or at operating points at which the limiter is active, i.e., the error cannot be fully corrected by the fuel amount correction, the air amount is also corrected. This means that either only the fuel amount or only the air amount is corrected or both amounts are corrected.

This means that the limitation is continuously adjustable for different operating points. The remaining fuel amount error is automatically compensated via the air amount.

If the integrator reaches the limiting value, the injected amount error is not fully corrected via fuel metering. Accordingly, the integrator input signal remains different from zero, i.e., the injected amount error is not equal to zero. This residual injected amount error is compensated via the air amount. The signs of the two interventions are opposite, which is ensured by inverter 142. The dynamics of the air branch may be calibrated independently of the fuel amount metering via filter 140, which may be implemented as a low-pass filter. The air amount branch has a slower dynamic response so that the learning of the fuel amount correction is not unnecessarily influenced.

At operating points at which first quantity MEI is known, correction values QME for the fuel amount to be injected and QML for the air amount are computed and saved, i.e., learned, in characteristics maps 134 and 144 as a function of the respective operating point. If first quantity MEI is not available, which is the case, for example, when lambda signal does not deliver permissible values, the value saved in characteristics maps 134 and 144 is used for correcting the fuel amount and/or the air amount.

Instead of characteristics maps 134 and 144, other learning functions or adaptive methods may also be used.

Figure 2:
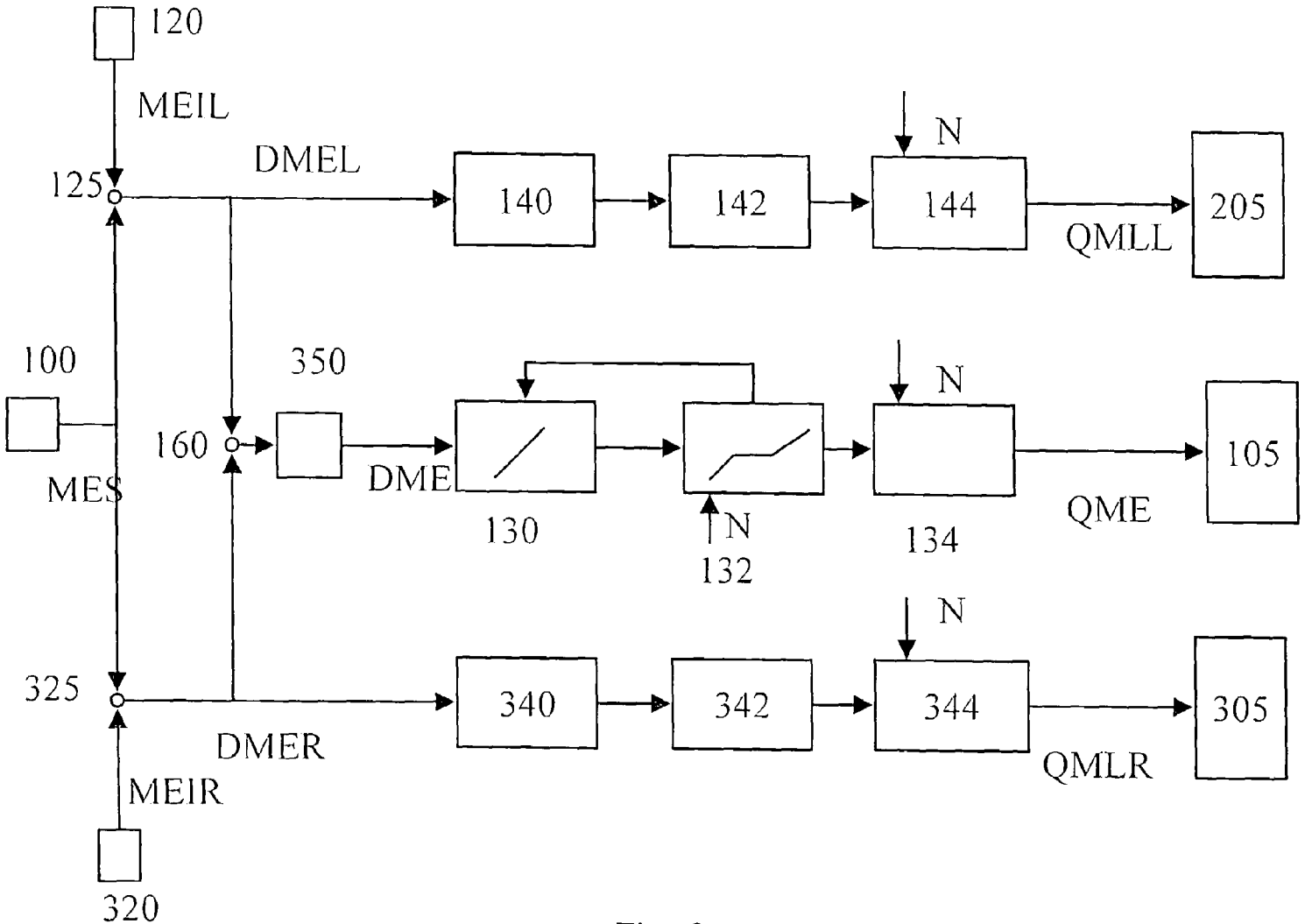
FIGS. 2 and 3 show block diagrams illustrating example embodiments of the present invention in the context of an internal combustion engine in which the cylinders of the engine are divided into at least two groups.

FIG. 2 shows another example embodiment of the procedure according to the present invention. This procedure is provided, e.g., for special engines known as V engines, which are designed as essentially two engines having cylinders in-line and a shared crankshaft. This embodiment, however, is not limited to such engines; it is generally applicable to engines in which the cylinders of the internal combustion engine are assigned to different banks/groups, an actuator for influencing the air amount being assigned to each bank/group.

The procedure is furthermore also applicable to a greater number of engine banks. In particular, the procedure is also applicable if an actuator for influencing the air amount is assigned to each cylinder.

Elements described in FIG. 1 are identified by the same reference numerals in FIG. 2. The embodiment of FIG. 2 differs from that of FIG. 1 in that two fuel amount calculators 120 are provided for the actually injected fuel amount. The fuel amount calculator for the first bank is identified as in FIG. 1. The fuel amount calculator for the second bank is designated by 320. The first quantity which is assigned to the first bank is referred to hereinafter as MEIL, and the first quantity which is assigned to the second bank is identified as MEIR. Node 125 of the first bank corresponds to node 325 of the second bank. The fuel amount error of the first bank is identified as DMEL and that of the second bank is identified as DMER. Elements corresponding to elements 140, 142, 144, and 205 of the first bank are designated for the second bank by 340, 342, 344, and 305. The operation of these elements is the same as that of the corresponding elements in FIG. 1.

Integrator 130 receives the output signal of a divider 350, which processes the output signal of node 160. Node 160 receives the injected amount error of first bank DMEL and the injected amount error of second bank DMER. This means that the integrator receives the mean value of the two injected amount errors of the two different banks. The input signals of fuel amount calculators 120 and 320 are provided by different sensors associated with the individual banks.

According to the example embodiment of the present invention shown in FIG. 2, the procedure of FIG. 1 is essentially transferred to each one of the banks, i.e., the individual elements are duplicated. The fuel amount is corrected in the same way for both banks. This is necessary because a different correction would interfere with other open-loop or closed-loop controls. If the limit is reached in correcting the fuel amount, the residual errors of the individual banks are compensated via air amount interventions. The same applies if different injected amount errors occur for the different banks. In this case, the mean error is compensated using the fuel amount intervention, and the residual errors of the individual banks are compensated using the air amount interventions.

Figure 3:
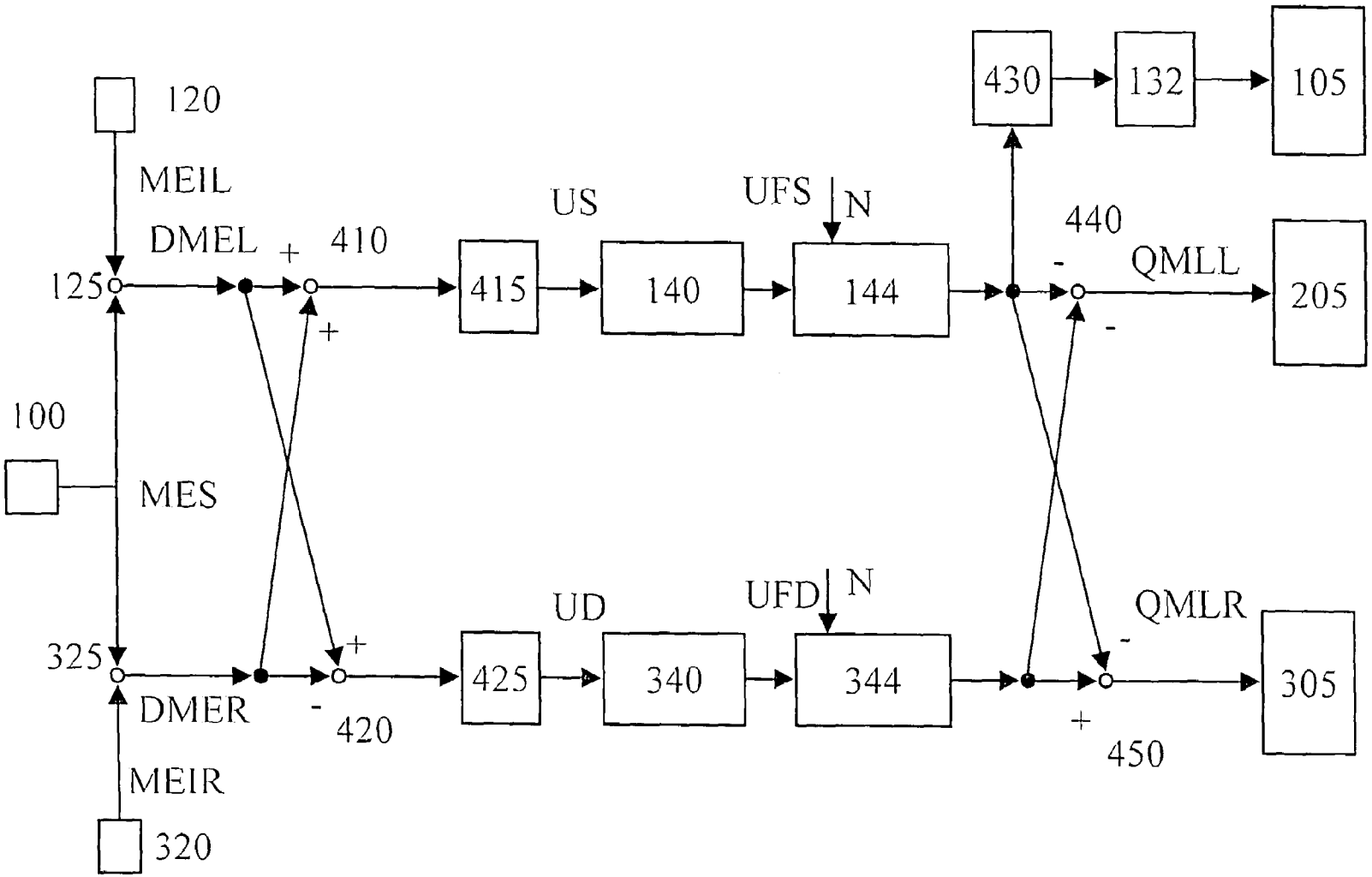

Another example embodiment is illustrated in FIG. 3. It essentially corresponds to the functionality of embodiment FIG. 2, but it requires less computer time and memory. Elements described in FIGS. 2 and 1 are designated by the same reference numerals in FIG. 3. Injected amount error DMEL of the first bank is supplied to a node 410 and a node 420. Similarly, injected amount error DMER of the second bank is also supplied to the two nodes 410 and 420. The sum of the two signals is formed in node 410, and the difference between the two signals is formed in node 420. Downstream dividers 415 and 425 divide the output signals of nodes 410 and 420 by two. Filter 140 thus receives the mean value of the two injected amount errors of the two banks. Filter 340 receives the difference with respect to the mean value. The output signal of characteristics map 144 is supplied to a filter 430 and the two nodes 440 and 450. The filter may be designed as a factorer. The output signal of characteristics map 344 is supplied to the two nodes 440 and 450. The output signal of filter 430 is supplied to limiter 132. Signal QMLL is applied to the output of node 440 and signal QMLR is applied to the output of node 450.

In this example embodiment of the present invention, the mean value and the half-difference, i.e., the deviation from the mean value of the individual errors, are learned in characteristics maps 144 and 344. The three correction terms QME, QMLL, and QMLR are determined from these quantities by appropriate adaptive gating with appropriate selection of the plus or minus sign. This means that elements 430 and 132 may be defined as a function of the operating point. The two interventions in the air amount are symmetrical with respect to the mean value and have opposite signs. As an alternative, characteristics maps 144 and/or 344 may also be designed as learning functions of any desired type.

Instead of an integrator, a low-pass filter 140 is used for learning the mean value. For this reason, the fuel amount error is never fully compensated via the intervention in the fuel amount. An intervention in the air amount is thus simultaneously used. The transmission characteristics of filter 430, like the limiting values of limiter 132, are definable as a function of the operating state.

In the embodiments of FIGS. 2 and 3, correction is performed via a uniform intervention in the fuel amounts for all cylinders. Correction by intervention in the air amount is performed individually for different cylinder groups. In this context, the correction may take place for individual cylinders or jointly for a plurality of cylinders. The number of correction values may correspond to the number of air mass meters and/or the number of actuators.

What is claimed is:

1. A method for controlling an internal combustion engine, comprising:

determining, based on performance characteristics, a first quantity characterizing an actual injected fuel amount and a second quantity characterizing a desired fuel amount to be injected;

comparing the first quantity to the second quantity; and defining, based on a result of the comparison, a first correction value for correcting a fuel amount and a second correction value for correcting an air amount, wherein the first correction value is limited to a selected maximum value.

2. The method as recited in claim 1, wherein at least one of the first correction value and the second correction value is adapted.

3. The method as recited in claim 1, wherein the maximum value is selected based on the performance characteristics.

4. The method as recited in claim 1, wherein at least one of the first correction value and the second correction value is saved as a function of the performance characteristics.

5. The method as recited in claim 1, wherein the second correction value is time-delayed with respect to the first correction value.

6. The method as recited in claim 1, wherein cylinders of the internal combustion engine are divided into at least two groups, and wherein different, second correction values are defined for the at least two groups of cylinders.

7. A device for controlling an internal combustion engine, comprising:

a control unit for controlling the following:

determining, based on performance characteristics, a first quantity characterizing an actual injected fuel amount and a second quantity characterizing a desired fuel amount to be injected;

comparing the first quantity to the second quantity; and defining, based on a result of the comparison, a first correction value for correcting a fuel amount and a second correction value for correcting an air amount, wherein the first correction value is limited to a selected maximum value.

* * * * *